US006469447B2

(12) United States Patent
Nakagawa et al.

(10) Patent No.: US 6,469,447 B2
(45) Date of Patent: Oct. 22, 2002

(54) FLUORESCENT LAMP LIGHTING APPARATUS

(75) Inventors: Hiroki Nakagawa, Ibaraki; Tetsuya Tahara, Kusatsu, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/852,561

(22) Filed: May 10, 2001

(65) Prior Publication Data

US 2002/0011791 A1 Jan. 31, 2002

(30) Foreign Application Priority Data

May 10, 2000 (JP) ..... 2000-137886

(51) Int. Cl.[7] ..... H01J 7/44

(52) U.S. Cl. ..... 315/46; 315/49; 315/50; 315/66; 313/37; 313/341; 313/271

(58) Field of Search ..... 315/46, 48, 49, 315/66, 112, 117, 309, 50; 313/37, 271, 341

(56) References Cited

U.S. PATENT DOCUMENTS 5,714,846 A * 2/1998 Rasch et al. ..... 315/225
6,274,988 B1 * 8/2001 De Vries ..... 315/307

FOREIGN PATENT DOCUMENTS

JP 62126596 6/1987

* cited by examiner

*Primary Examiner*—Don Wong
*Assistant Examiner*—Tuyet T. Vo
(74) *Attorney, Agent, or Firm*—Michael K. Kelly; Snell & Wilmer, LLP

(57) ABSTRACT

A fluorescent lamp lighting apparatus includes a fluorescent light emitting tube; and an electronic lighting circuit for applying an electric current to the fluorescent light emitting tube. The electronic lighting circuit includes a pair of electrode filaments provided in the fluorescent light emitting tube, a pair of capacitors each connected in series to a respective one of the pair of electrode filaments and connected parallel to the fluorescent light emitting tube, and an inductor connected in series to one of the pair of electrode filaments.

3 Claims, 6 Drawing Sheets

PRIOR ART

PRIOR ART

PRIOR ART

PRIOR ART

FLUORESCENT LAMP LIGHTING APPARATUS

BACKGROUND OF THE INVENTION

1. Field of the Invention

The present invention relates to a fluorescent lamp lighting apparatus for lighting up a fluorescent light emitting tube using an electronic lighting circuit.

2. Description of the Related Art

In recent years, as energy savings have become more and more important, an increasing number of fluorescent lamp light apparatuses have adopted a high frequency inverter type electronic lighting circuit, instead of a copper-iron stabilizer as conventionally used. Specifically for a light bulb type fluorescent lamp built in the lighting apparatus as an energy-saving light source replacing a light bulb, the use of this type of electronic lighting circuits is becoming more common in order to realize a lamp having a higher lamp efficiency or light emission efficiency and less weight.

In order to improve the lamp efficiency of the electronic lighting circuit for a light bulb type fluorescent lamp, there has been an attempt to improve the circuit conversion efficiency of the electronic lighting circuit. As a result, the circuit conversion efficiency which was about 80% has been increased to a maximum of about 92%. This has been realized by introducing a series inverter circuit system in an electronic light circuit or by using a MOS field emission power transistor as an electronic component. The value of about 92% is almost the maximum possible value for a circuit conversion efficiency. In order to further improve the lamp efficiency, a different new technique, for example, a technique for reducing a power loss caused by heat generation in an electrode filament coil in the fluorescent light emitting tube is demanded.

FIG. 4 is a diagram illustrating a basic structure of a conventional high frequency inverter type electronic lighting circuit 19 (hereinafter, referred to simply as the "electronic lighting circuit 19"). The electronic lighting circuit 19 includes an Inverter circuit section 25 which is driven by a commercial power supply 13. The inverter circuit section 25 lights up a fluorescent light emitting tube 20.

The fluorescent light emitting tube 20 includes a pair of electrode filament coils 21 and 22. The electrode filament coils 21 includes terminals 21*a* and 21*b*, and the electrode filament coils 22 includes terminals 22*a* and 22*b*. The terminals 21*a* and 22*a* are closet than the terminals 22*b* and 22*b* to the power supply 13 for applying an electric current to the fluorescent light emitting tube 20.

The terminal 22*a* of the electrode filament coil 22 is directly connected to the inverter circuit section 25. The terminal 21*b* of the electrode filament coil 21 is connected to the inverter circuit section 25 via an inductor 24 provided for electric current control. The inductor 24 is connected in series to the terminal 21*a*. The terminals 21*b* and 22*b* of the electrode filament coils 21 and 22 are connected to each other via a capacitor 23. The capacitor 23 and the inductor 24 are included in a resonating circuit. In FIG. 4, an inductance of the inductor 24 is represented by "L", and a capacitance of the capacitor 23 is represented by "Cs".

The conventional electronic lighting circuit 19 performs an operation for starting and thus placing a fluorescent lamp into a constant lighting state, using a hot cathode starting system. This will be described below.

Before starting the lamp, the inverter circuit section 25 causes an electric current to flow to the electrode filament coils 21 and 22 of the fluorescent light emitting tube 20 through the capacitor 23 in order to pre-heat the electrode filament coils 21 and 22 and thus cause the electrode filament coils 21 and 22 to emit a sufficient amount of thermoelectric. The capacitor 23 is connected parallel to the fluorescent light emitting tube 20.

When the pre-heating electric current is flown to the electrode filament coils 21 and 22, a starting voltage is applied between the electrode filament coils 21 and 22 within about 1 second, and thus the fluorescent light emitting tube 20 is started. The starting voltage corresponds to a resonating voltage of the resonating circuit including the capacitor 23 and the inductor 24.

The fluorescent light emitting tube 20, after being started, goes into a constant lighting state. In this state, the electric current still flows to the electrode filament coils 21 and 22 via the capacitor 23, and thus heat is generated in the electrode filament coils 21 and 22.

As described above, the conventional electronic lighting circuit 19 realizes the constant lighting state of the fluorescent light emitting tube 20 after pre-heating the electrode filament coils 21 and 22 and then starting the fluorescent light emitting tube 20. After the fluorescent light emitting tube 20 goes into the constant lighting state, the electric current is basically unnecessary. However, since an electric current is required in order to pre-heat the electrode filament coils 21 and 22 by the conventional method using the capacitor 23, the electric current inevitably flows even after the fluorescent light emitting tube 20 goes into the constant lighting state and thus generates heat in the electrode filament coils 21 and 22. This heat generation causes a power loss.

In a currently-used light bulb type fluorescent lamp (for example, a 14 W or 25 W light bulb) which has a luminous flux corresponding to that of a general 60 W or 100 W light bulb, the power loss caused by the heat generation is 0.4 W to 0.5 W per electrode filament coil. In the fluorescent light emitting tube 20, the power loss caused by the heat generation is 0.8 W to 1.0 W per electrode filament coil. These values are not negligible.

FIGS. 5A through 5C show known electronic light circuits used for reducing such a power loss caused by the heat generation In an electrode filament coil during a constant light state of the fluorescent light emitting tube 20. Like elements as those in FIG. 4 bear identical reference numerals.

An electronic light circuit 19*a* shown in FIG. 5A adopts a so-called cold cathode starting system. The electrode filament coils 21 and 22 of the fluorescent light emitting tube 20 are respectively shortcircuited by leads 26 and 27. The leads 26 and 27 are respectively connected parallel to the electrode filament coils 21 and 22. The fluorescent light emitting tube 20 is started in a cold cathode state with no thermoelectrons being emitted. Due to such a structure, the power lose caused by the heat generation in the electrode filament coils 21 and 22 is reduced.

An electronic lighting circuit 19*b* shown in FIG. 5B is disclosed in Japanese Laid-Open Publication No. 10-199686. Diodes 28 and 29 are respectively connected parallel to the electrode filament coils 21 and 22 of the fluorescent light emitting tube 20. Due to such a structure, the amount of the electric current flowing to each of the electrode filament coils 21 and 22 is reduced to half. Thus, the power loss caused by the heat generation is also reduced to about half.

An electronic lighting circuit 19*c* shown in FIG. 5C is disclosed in Japanese Laid-Open Publication No. 5-13186.

Capacitors 31 and 32 are respectively connected parallel to the electrode filament coils 21 and 22 of the fluorescent light emitting tube 20., The capacitor 31 branches the electric current into the capacitor 31 and the electrode filament coil 21, and the capacitor 32 branches the electric current into the capacitor 32 and the electrode filament coil 22. Due to such a structure also, the amount of the electric current flowing to each of the electrode filament coils 21 and 22 is reduced. Thus, the power loss caused by the heat generation is also reduced.

Fluorescent lamps are now expected to be used in houses which is one important field of use of light bulbs, in addition to department stores, restaurants, hotels and other business settings in which the fluorescent lamps are mainly used conventionally. Generally in fluorescent lamps, an electron radiating substance filling the electrode filament coils at the time of starting the lamp easily scatters. Accordingly, it is known that as the number of times the fluorescent lamp is lit on or off is increased, the life of the lamp is shortened. This is also true with light bulb type fluorescent lamps. Lamps which are used in houses are inevitably lit on or off a greater number of times than lamps used in business settings. It is demanded to increase the number of times the lamp can be lit on and off until the life of the lamp ends (hereinafter, the number of times the lamp cam be lit on and off until the life of the lamp ends will be referred to as the "lamp life light on/off characteristic").

The lamp life lighting on/off characteristic is conventionally about 5000 times. Now, the lamp life lighting on/off characteristic is demanded to be increased to be 4 times larger, i.e., a t least 20000 times. According to an experiment performed by the prevent inventors, the average life of the conventional lamp was 6000 hours. This corresponds to an average life obtained in a test by which the lamp is kept on for 2.5 hours and then kept off for 0.5 hours.

In order to respond to. this demand, Japanese Laid-Open Publication No. 62-126596 discloses an electronic lighting circuit 40 shown in FIG. 6. A temperature positive characteristic resistance element (positive character thermistor or PCT) 33 Is connected parallel to the capacitor 23 so as to be opposite to the commercial power supply 13 with respect to the fluorescent light emitting tube 20. Due to such a. structure, a large amount of pre-heating electric current flows to the electrode filament coils 21 and 22 via the temperature positive characteristic resistance element 33 before the fluorescent light emitting tube 20 is started. Thus, the lamp life lighting on/off characteristic is improved.

The present inventors performed studies on a fluorescent lamp using an electronic lighting circuit, especially a light bulb type fluorescent lamp having a built-in electronic lighting circuit, In order to realize both reduction in a power loss caused by the heat generation in an electrode filament coil in the constant lighting state of the lamp and increase in the lamp life lighting on/off characteristic. As a result, the present inventors found that the electronic lighting circuits shown in FIGS. 5A through 5C have an undesirable possibility that the lamp life lighting on/off characteristic is not increased.

In the cold cathode starting system shown in FIG. 5A with no emission of thermoelectrons, the power loss caused by the heat generation in the coils can sufficiently be reduced. However, the voltage for starting the fluorescent light emitting tube 20 needs to be applied for an extended period of time. Thus, the glow discharge time period, immediately after the fluorescent light emitting tube 20 is started, is also relatively long. As a result, the electron radiating substance filling the electrode filament coils 21 and 22 scatters more violently than in a circuit adopting the usual hot cathode starting system, and therefore there is an undesirable possibility of reducing the lamp life lighting on/off characteristic.

In the structure shown in FIG. 5B including the diodes 28 and 29 connected parallel to the electrode filament coils 21 and 22 and the structure shown in FIG. 5C including the capacitors 31 and 32 connected parallel to the electrode filament coils 21 and 22, the effect of reducing the power loss is relatively small. Moreover, a sufficient number of thermoelectrons are not emitted since a sufficient amount of pre-heating electric current does not flow to the electrode filament coils 21 and 22 before the fluorescent light emitting tube 20 is started. As a result, a larger amount of electron radiating substance scatters, which involves an undesirable possibility of not increasing the lamp life lighting on/off characteristic.

In the structure shown in FIG. 6, a sufficient amount of pre-heating electric current can flow to the electrode filament coils 21 and 22 before an electric current for starting the fluorescent light emitting tube 20 flows, which significantly increases the lamp life lighting on/off characteristic. However, the power loss caused by the heat generation in the electrode filament coils 21 and 22 during the constant light state of the fluorescent light emitting tube 20 is not reduced. The power loss is almost the same as that in the conventional electronic lighting circuit 19 shown in FIG. 4.

SUMMARY OF THE INVENTION

A fluorescent lamp lighting apparatus according to the present invention includes a fluorescent light emitting tube; and an electronic lighting circuit for applying an electric current to the fluorescent light emitting tube. The electronic lighting circuit includes a pair of electrode filaments provided in the fluorescent light emitting tube, a pair of capacitor each connected in series to a respective one of the pair of electrode filaments and connected parallel to the fluorescent light emitting tube, and an inductor connected in series to one of the pair of electrode filaments.

In one embodiment of the invention, the electronic lighting circuit further includes a temperature positive characteristic resistance element connected parallel to the pair of capacitors.

In one embodiment of the invention, the electronic lighting circuit further includes an inverter circuit section for applying an electric current for lighting up the fluorescent light emitting tube.

According to the present invention, the electronic lighting circuit includes an inductor connected in series to a fluorescent light emitting tube and a pair of capacitors each connected parallel to the fluorescent light emitting tube. The inductor and the pair of capacitors form a resonating circuit. In such a resonating circuit, the pair of capacitors can be considered as one parallel synthesis capacitor which is connected in series to the fluorescent light emitting tube. A resistance of a pair of electrode filament coils provided in the fluorescent light emitting tube can be considered as one resistance, obtained as a result of synthesizing two parallel resistances, which is connected in series to the resonating circuit.

Since the resistance of the pair of electrode filament coils is considered as one resistance obtained as a result of synthesizing two parallel resistances, the resistance impedance which contributes to the resistance of the pair of electrode filament coils is reduced. Accordingly, the fluorescent light emitting tube is started rapidly, and thus the lamp life lighting on/off characteristic of the fluorescent light emitting tube is improved. In the constant lighting state after the fluorescent light emitting tube is started, the electric current which unnecessarily heats the electrode filament coils is divided into two, and thus the value of the electric current in each electrode filament coil is reduced. As a result, the power loss caused by the heat generation in the electrode filament coils is reduced.

The lamp life lighting on/off characteristic is further improved by providing the temperature positive characteristic resistance element which is connected parallel to the pair of capacitors so that the temperature positive characteristic resistance element is opposite to a power supply, for applying an electric current to the fluorescent light emitting tube, with respect to the fluorescent light emitting tube.

Thus, the invention described herein makes possible the advantages of providing a fluorescent lamp lighting apparatus for reducing a power loss caused by heat generation in an electrode filament coil during a constant lighting state of a fluorescent light emitting lamp and also increasing the lamp life lighting on/off characteristic of the fluorescent light emitting lamp.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

Figure 1:
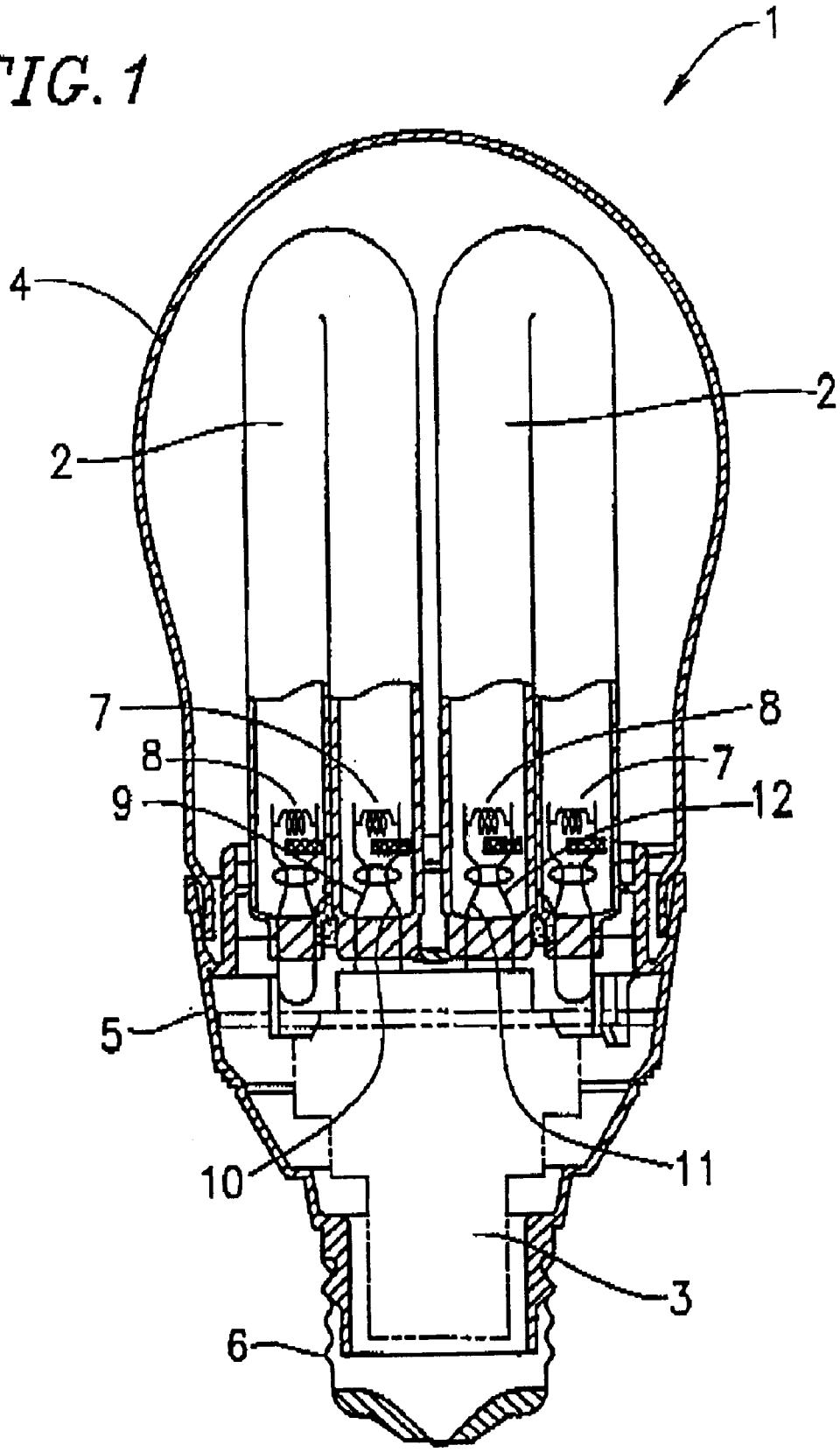
FIG. 1 is a cross-sectional view of a light bulb type fluorescent lamp as one example of a fluorescent lamp lighting apparatus according to the present invention.

FIG. 1 is a cross-sectional view of a 22 W light bulb type fluorescent lamp 1 as one example of a fluorescent lamp lighting apparatus according to the present invention.

The light bulb type fluorescent lamp 1 includes four fluorescent light emitting tubes 2, an outer glass bulb 4 for covering the four fluorescent light emitting tubes 2, a resin case 5 connected to a base end of the outer glass bulb 4, an electronic lighting circuit 3 generally accommodated in the resin case 5, and a base 6 attached to a bass and of the resin case 5. The number of the fluorescent light emitting tubes 2 is not limited to four, but can be any integral number of one or greater.

The fluorescent light emitting tubes 2 are each a U-shaped glass tube, and the four fluorescent light emitting tubes 2 are connected in series so as to form one discharge path. Each fluorescent light emitting tube 2 substantially accommodates a pair of electrode. filament coils 7 and 8. The fluorescent light emitting tube 2 can accommodate any type of filaments which can emit thermoelectrons when an electric current flows therein; for example, the filament coils 7 and 8 as described in this example.

The electrode filament coil 7 is supported in one end portion of each fluorescent light emitting tube 2 by a pair of leads 9 and 10. The electrode filament coil 8 is supported in the other end portion of each fluorescent light emitting tube 2 by a pair of leads 11 and 12. The electrode filament coils 7 and a of each fluorescent light emitting tube 2 are extended outside the fluorescent light emitting tube 2 in the form of the leads 9 through 12, so that the electronic lighting circuit 3 generally accommodated in the resin case 5 also includes the electrode filament coils 7 and 8.

Each fluorescent light emitting tube 2 accommodates a main amalgam element (Bi-Pb-Sn-Hg granules) and an assisting amalgam element (In-plated stainless mesh), and also contains argon gas sealed therein as a buffering gas. The electrode filament coils 7 and 8 each have three turns, which is suitable to improve the lamp life lighting on/off characteristic. Each fluorescent light emitting tube 2 is also filled with a usual Ba—Ca—Sr—O-based electron radiating substance. A main portion of an inner wall of each fluorescent light emitting tube 2 is coated with a three-colored rare earth fluorescent material for emitting red, green and blue light.

Each fluorescent light emitting tube 2 has, for example, an outer diameter of about 10.7 mm and an inter-electrode distance of about 490 mm.

The electronic lighting circuit 3 is of a series inverter circuit system type, and has a circuit conversion efficiency of about 91%. The electronic lighting circuit 3 is connected to a commercial power supply (not shown In FIG. 1) via the bass 6 which is attached to the base and of the resin case 5.

Figure 2:
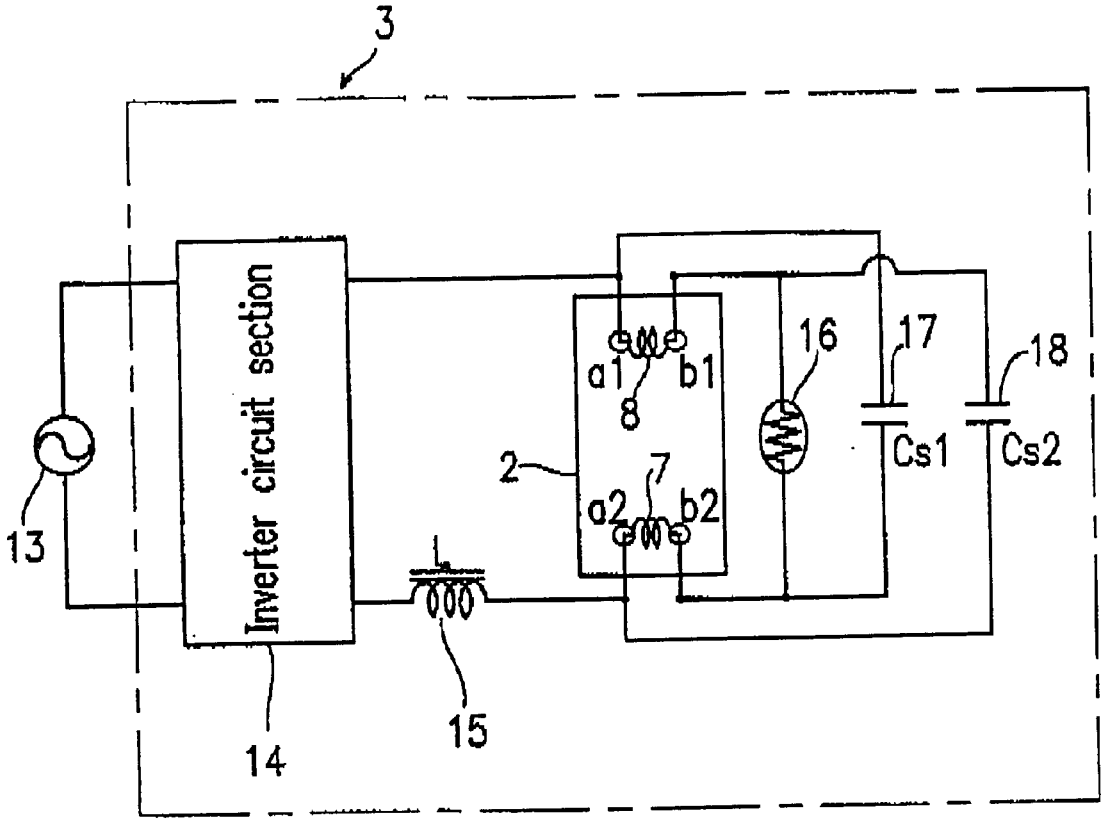
FIG. 2 is a circuit diagram illustrating a structure of an electronic lighting circuit used in the fluorescent lamp lighting apparatus shown in FIG. 1.

FIG. 2 is a circuit diagram illustrating a structure of the electronic lighting circuit 3.

The electronic lighting circuit 3 includes the electrode filament coils 7 and 8, an inverter circuit section 14, an inductor 15, a temperature positive characteristic resistance element (positive character thermistor or PCT) 16, a first capacitor 17 and a second capacitor 18. The electrode filament coil 7 has terminals a2 and b2, and the electrode filament coil 8 has terminals a1 and b1. The terminals a1 and a2 are closer than the terminals b1 and b2 to a commercial power supply 13 for applying an electric current to the fluorescent light emitting tube 2.

The inverter circuit section 14 which is driven by the commercial power supply 13 lights up the fluorescent light emitting tube 2. The terminal a1 of the electrode filament coil 8 is directly connected to the inverter circuit section 14. and the terminal a2 of the electrode filament coil 7 in connected to the inverter circuit section 14 via the inductor 15 provided for electric current control. The inductor 15 is connected in series to the terminal a2.

The temperature positive characteristic resistance element 16 is connected in series between the terminal b2 of the electrode filament coil 7 and the terminal b1 of the electrode filament coil 8.

The first capacitor 17 is connected in series between the terminal b2 of the electrode filament coil 7 and the terminal a1 of the electrode filament coil 8. The second capacitor 18 is connected in series between the terminal a2 of the electrode filament coil 7 and the terminal b1 of the electrode filament coil 8.

Figure 4:
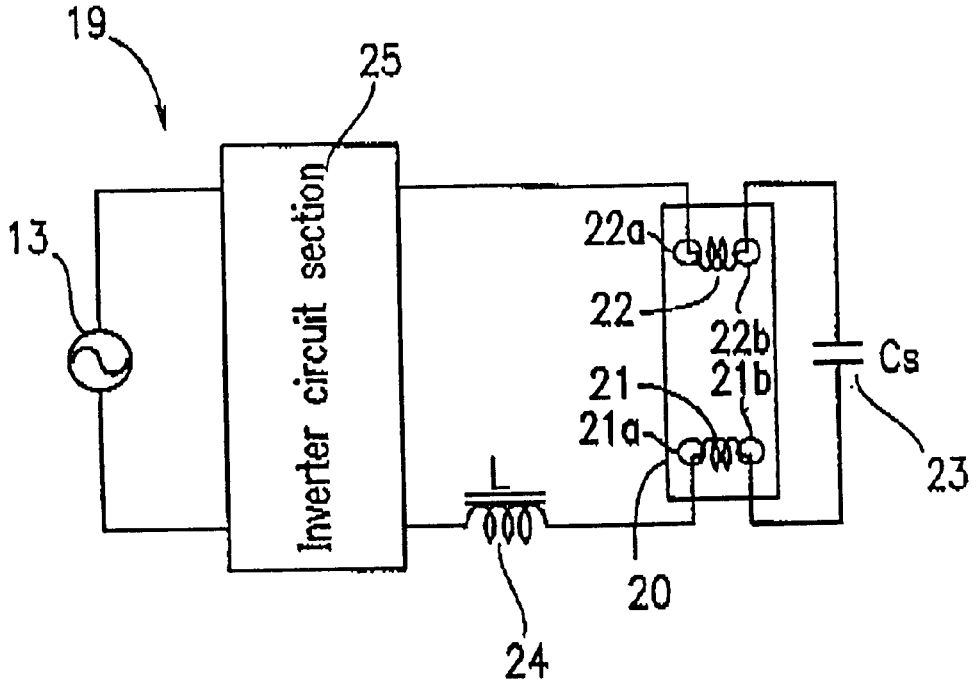
FIG. 4 is a circuit diagram illustrating a basic structure of a conventional electronic lighting circuit.
Figure 5A:
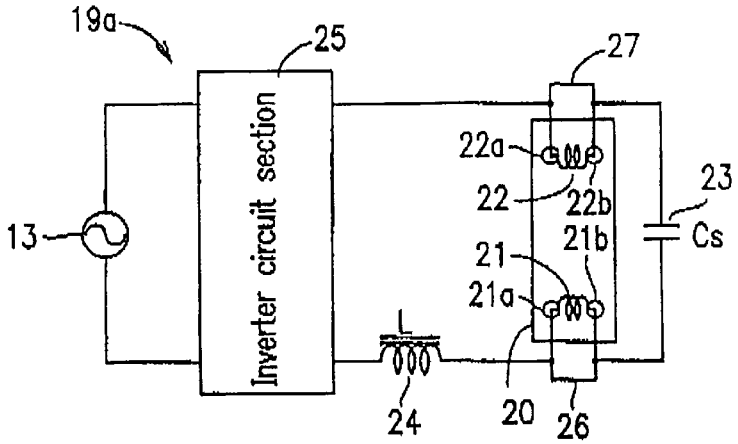
FIGS. 5A through 5C are each a circuit diagram of a conventional electronic light circuit proposed for reducing a power loss caused by heat generation in an electrode filament coil of a fluorescent lamp lighting apparatus.
Figure 5B:
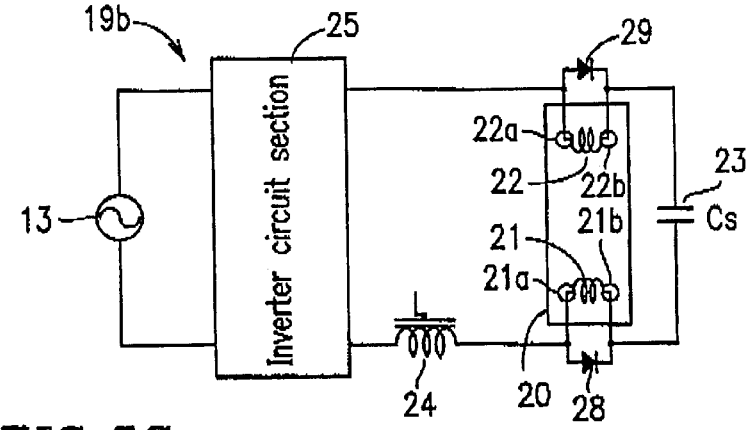
PRIOR ART FIG. 5B
Figure 5C:
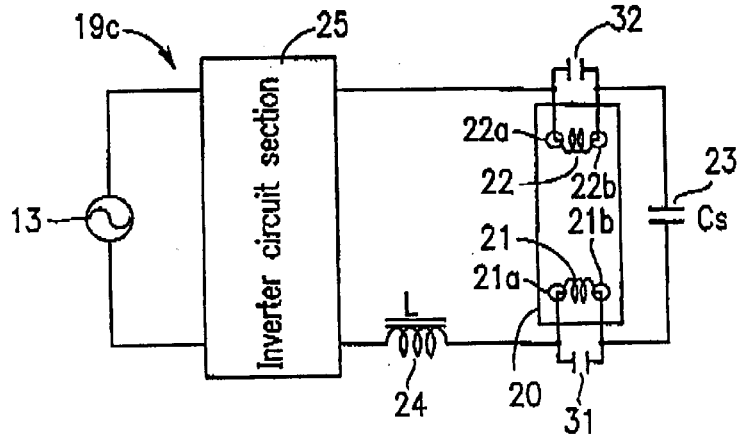
PRIOR ART FIG. 5C

Preferably, a capacitance Cs1 of the first capacitor 17 is substantially equal to a capacitance Cs2 of the second capacitor 18, and the capacitances Cs1 and Cs2 are each set to be ½ of the capacitance Cs (for example, 1000 pF) of the capacitor 23 shown in FIG. 4. For example, the capacitances Cs1 and Cs2 are each set to be 500 pF. It should be noted that the capacitance Cs1 of the first capacitor 17 and the capacitance Cs2 of the second capacitor 18 are not required to be necessarily substantially equal to each other.

The first and second capacitors 17 and 18 are collectively considered as a single parallel synthesis capacitor (capacitance: Cs1+Cs2=Cs). The parallel synthesis capacitor and the inductor 15 together act as a resonating circuit. The resonating circuit generates a prescribed starting voltage. The first and second capacitors 17 and 18 act as described below to reduce the power loss by heat generation in the electrode filament coils 7 and 8 in the constant lighting state and also to improve the lamp life lighting on/off characteristic of the fluorescent light emitting tube 2.

The temperature positive characteristic resistance element 16 flows a sufficient amount of pre-heating electric current to the electrode filament coils 7 and 8 before an electric current for starting the fluorescent light emitting tube 2 flows as described below, and thus further improves the lamp life lighting on/off characteristic of the fluorescent light emitting tube 2.

An operation of the electronic lighting circuit 3 having the above-described structure will be described. Specifically, a starting process operation for pre-heating and thus placing the fluorescent light emitting tube 2 into a constant lighting state will be described in detail. In more detail, by the starting process operation, a switch of the light bulb type fluorescent lamp 1 is turned on to cause the commercial power supply 13 to supply an AC current, and then a starting voltage is applied to the electrode filament coils 7 and 8 of each fluorescent light emitting tube 2.

The capacitors 17 and 18 and the temperature positive characteristic resistance element 16 are connected parallel to one another, and the temperature positive characteristic resistance element 16 has a relatively low temperature before the fluorescent light emitting tube 2 is started. Therefore, the resistance impedance of the temperature positive characteristic resistance element 16 is relatively low. Such a low resistance impedance of the temperature positive characteristic resistance element 16 offers the following advantages.

(1) The electric current for pre-heating the electrode filament coils 7 and 8 mainly flows through the temperature positive characteristic resistance element 16 having the low resistance impedance, rather than the capacitor 17 or 18. This allows the pre-heating current to be set at a relatively high value. Therefore, the electrode filament coils 7 and 8 can be efficiently pre-heated within a time period of as short as 1 second before the fluorescent light emitting tube 2 is started. Thus, a sufficient amount of thermoelectrons can be emitted.

As a result, the fluorescent light emitting tube 2 is started rapidly by applying the starting voltage for only a short period. Thus, the glow discharge time period, immediately after the fluorescent light emitting tube 2 is started, is shortened. As a result, the scattering of the electron radiating substance filling the electrode filament coils 7 and 8 is. restricted during the starting process. Accordingly, the problem that, a larger amount of electron radiating substance scatters by applying the starting voltage to the electrode filament coils 7 and 8 without preheating the coils 7 and 8 before the fluorescent light emitting tube 2 is started, is avoided. Therefore, the lamp life lighting on/off characteristic is increased.

(2) Due to the relatively low resistance impedance of the temperature positive characteristic resistance element 16, the resonating circuit including the inductor 15 and the first and second capacitors 17 and 18 generates substantially no resonating voltage by a so-called resonating phenomenon. Thus, while the temperature of the electronic lighting circuit 3 is sufficiently low, the starting voltage is not applied to the fluorescent light emitting tube 2.

The above-mentioned time period of within 1 second before the fluorescent light emitting tube 2 is started is required for a light bulb type fluorescent lamp to be used instead of a general bulb having a feature of being instantaneously lit up. The time period is usually set to be 0.6 to 0.8 seconds.

The resistance impedance of the temperature positive characteristic resistance element 16 is rapidly increased as the temperature increases due to the Joule heat generated by the pre-heating current. Due to the resonating phenomenon caused by the parallel synthesis capacitor (capacitors 17 and 18) and the inductor 15, a starting voltage corresponding to the resonating voltage of the resonating circuit is applied between the electrode filament coils 7 and 8.

Due to the rapid temperature increase of the temperature positive characteristic resistance element 16, the fluorescent light emitting tube 2 is started by applying the starting voltage for only a short time period. Thus, the lamp life lighting on/off characteristic is improved.

Figure 3A:
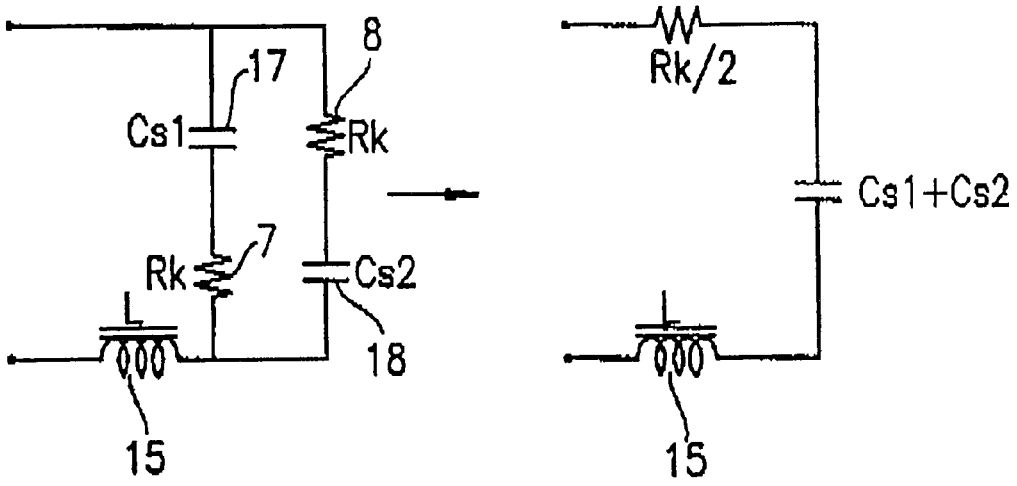
FIG. 3A shows a circuit diagram of a resonating circuit portion of the electronic lighting circuit shown in FIG. 2 and an equivalent circuit diagram thereof.

FIG. 3A shows a circuit diagram of the resonating circuit portion of the electronic lighting circuit 3. (FIG. 2) and an equivalent circuit diagram thereof. A resistance Rk of the electrode filament coil 7 and a resistance Rk of the electrode filament coil 8 is collectively considered as a parallel synthesis resistance Rk/2. The parallel synthesis resistance Rk/2 is connected in series to the resonating circuit, including the parallel synthesis capacitor and the inductor 15.

Figure 3B:
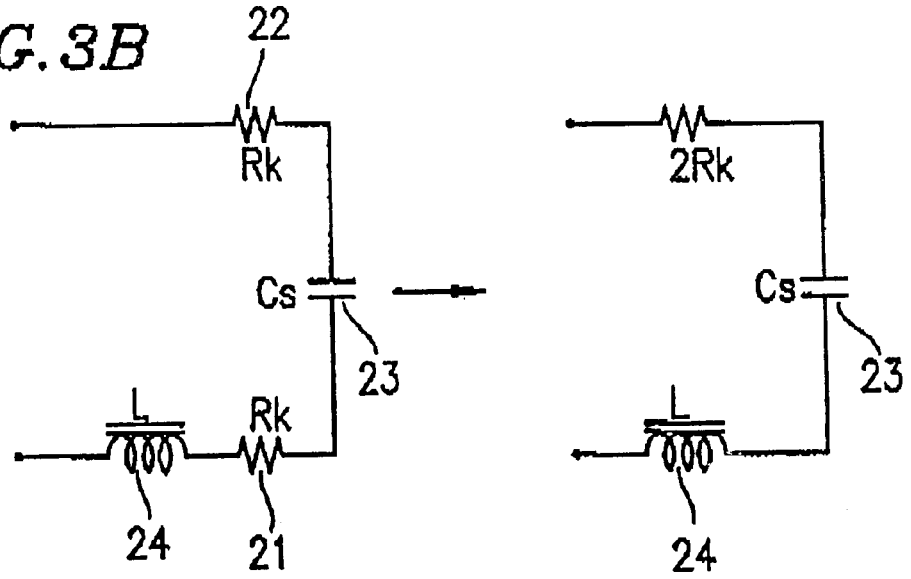
FIG. 3B shows a circuit diagram of a resonating circuit portion of a conventional electronic lighting circuit and an equivalent circuit diagram thereof.

For comparison, FIG. 3B shows a circuit diagram of the resonating circuit portion of the conventional electronic lighting circuit 19 (FIG. 4) and an equivalent circuit diagram thereof. A resistance Rk of the electrode filament coil 21 and a resistance Rk of the electrode filament coil 22 are collectively considered as a series synthesis resistance 2Rk. The series synthesis resistance 2Rk is connected in series to the resonating circuit including the capacitor 23 and the Inductor 24.

The parallel synthesis resistance Rk/2 of the electrode filament coils 7 and 8 of the electronic lighting circuit 3 is ¼ of the series synthesis resistance 2Rk of the electrode filament coils 21 and 22 of the conventional electronic lighting circuit 19. Therefore, the starting voltage of the electronic lighting circuit 3 corresponding to the resonating voltage of the resonating circuit increases to a higher value and more rapidly than the conventional electronic lighting circuit 19. As a result, the time period in which the starting voltage is applied is shortened, which, in turn, starts the fluorescent light emitting tube 2 more rapidly.

During the constant lighting state immediately after the fluorescent light emitting tube 2 is started, the electric current is divided into two and flows through the electrode filament coils 7 and 8 respectively via the capacitor 17 having a capacitance of Cs1 and the capacitor 18 having a capacitance of Cs2. When, for example, Cs1=Cs2=Cs/2, the amount of the current flowing in each of the electrode filament coils 7 and 4 is ½ of the current flowing in the filament coils 21 and 22 of the electronic lighting circuit 19 (FIG. 4). Therefore, the electronic lighting circuit 3 reduces the power loss caused by the heat generation to ¼ as compared to the conventional electronic lighting circuit 19. In the conventional electronic lighting circuit 19, the series connection of the electrode filament coils 21 and 22 increases the power loss.

Thus, the power loss during the constant lighting state of the fluorescent light emitting tube 2 is reduced with more certainty than by the conventional technology.

The light bulb type fluorescent lamp 1 according to the present invention including the electronic lighting circuit 3 was tested for the power of the electrode filament coils and the lamp life lighting on/off characteristic. The lamp life lighting on/off characteristic was measured by repeating the cycle of keeping the fluorescent light emitting tubes 2 on for 10 seconds and keeping the tubes 2 off for 170 seconds. The tubes 2 were kept for 170 seconds since 170 seconds was required to cool down the temperature positive characteristic resistance element 16. The power and the lamp life lighting on/off characteristic, was found by averaging the values obtained with five samples of the light bulb type fluorescent lamp 1 tested.

The light bulb type fluorescent lamp 1 exhibited a power of 22.3 W and a luminous flux of 1520 lm.

Figure 6:
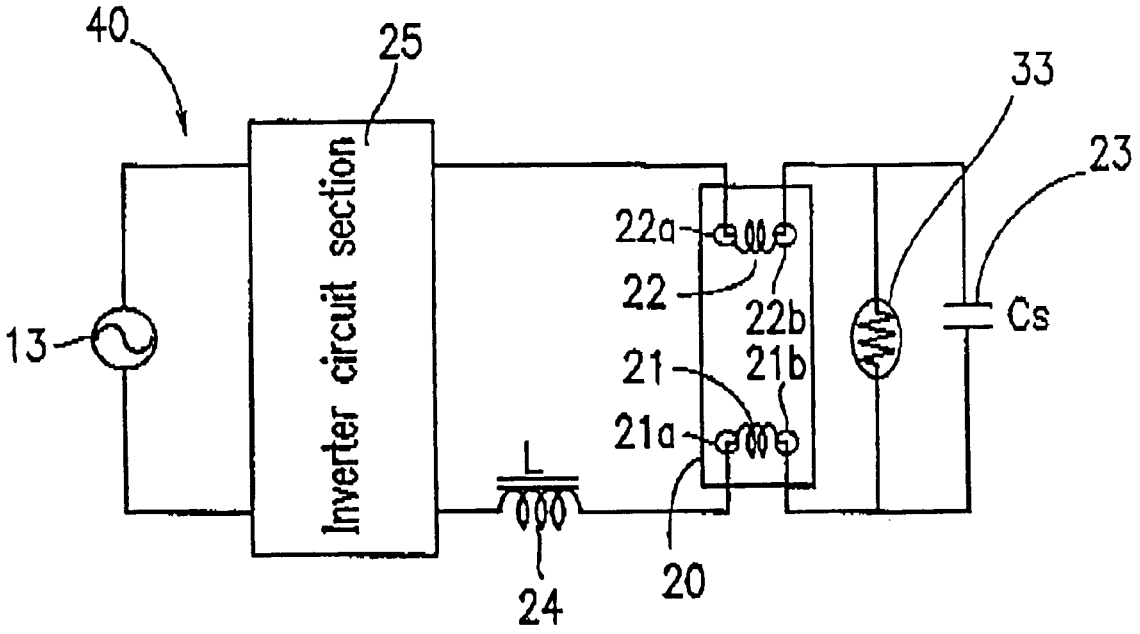
FIG. 6 is a circuit diagram of a conventional electronic light circuit proposed for improving a lamp life lighting on/off characteristic of a fluorescent lamp lighting apparatus.

For comparison, the same test was performed for a light bulb type fluorescent lamp including the electronic lighting circuit 19 (FIG. 4) and a light bulb type fluorescent lamp including electronic lighting circuit 40 (FIG. 6). The light bulb type fluorescent lamp including electronic lighting circuit 40 exhibited a power of 23.0 W and a lunindus flux of 1510 lm. The electronic lighting circuit 3 according to the present invention reduces the power loss of about 0.7 W as compared to the conventional electronic lighting circuit 40 which was proposed to improve the lamp life lighting on/off characteristic.

The light bulb type fluorescent lamp 1 according to the present invention including the electronic lighting circuit 3 showed a lamp life lighting on/off characteristic of 22500 times, whereas the light bulb type fluorescent lamp including the electronic lighting circuit 40 showed a lamp life lighting on/off characteristic of 17540 times. The light bulb type fluorescent lamp including the electronic lighting circuit 19, which does not include any means for improving the lamp life lighting on/off characteristic such as a temperature positive characteristic resistance element, showed a lamp life lighting on/off characteristic of 6950 times. As can be appreciated, the electronic lighting circuit 3 significantly improves the lamp life lighting on/off characteristic.

The electronic lighting circuit 3 including the temperature positive characteristic resistance element 16 and the two capacitors 17 and 18 improves the lamp life lighting on/off characteristic even as compared to the electronic lighting circuit 40 including the temperature positive characteristic resistance element 33 but not including the parallel synthesis capacitor. The electronic lighting circuit 3 realizes the intended lamp life lighting on/off characteristic of at least 20000 times.

The electronic lighting circuit 3 includes the inverter circuit section 14, but the inverter circuit section 14 can be provided outside the electronic lighting circuit 3 so long as the electronic lighting circuit 3 receives an AC current.

In the above-described example, one inductor 15, one first capacitor 17 and one second capacitor 18 are provided for one fluorescent light emitting tube 2. Alternatively, one inductor 15, one first capacitor 17 and one second capacitor 18 can be provided for a plurality of fluorescent light emitting tubes 2.

As described above, according to the present invention, the electronic lighting circuit includes a pair of capacitors each connected in series to the electrode filament coils of a fluorescent light emitting tube. Due to such a structure, the power loss caused by the heat generation in the electrode filament coils is sufficiently reduced in the constant lighting state, also the lamp life lighting on/off characteristic of the fluorescent light emitting tube is improved.

In one embodiment, the electronic lighting circuit includes a temperature positive characteristic resistance element provided so as to be opposite to a commercial power supply for applying an electric current to the fluorescent light emitting tube, with respect to the fluorescent light emitting tube. Due to such a structure, the lamp life lighting on/off characteristic is further improved to be at least 20000 times while the effect of reducing the power loss is sufficiently maintained.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A fluorescent lamp lighting apparatus, comprising:

a fluorescent light emitting tube; and an electronic lighting circuit for applying an electric current to the fluorescent light emitting tube, wherein the electronic lighting circuit includes:

a pair of electrode filaments provided in the fluorescent light emitting tube, a pair of capacitors each connected in series to a respective one of the pair of electrode filaments and connected parallel to the fluorescent light emitting tube, and an inductor connected in series to one of the pair of electrode filaments.

2. A fluorescent lamp lighting apparatus according to claim 1, wherein the electronic lighting circuit further includes a temperature positive characteristic resistance element connected parallel to the pair of capacitors.

3. A fluorescent lamp lighting apparatus according to claim 1, wherein the electronic lighting circuit further includes an inverter circuit section for applying an electric current for lighting up the fluorescent light emitting tube.

* * * * *